US007400094B2

(12) United States Patent
Meddaugh

(10) Patent No.: US 7,400,094 B2
(45) Date of Patent: Jul. 15, 2008

(54) STANDING WAVE PARTICLE BEAM ACCELERATOR HAVING A PLURALITY OF POWER INPUTS

(75) Inventor: Gard E. Meddaugh, Mountain View, CA (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 355 days.

(21) Appl. No.: 11/212,471

(22) Filed: Aug. 25, 2005

(65) Prior Publication Data

US 2007/0046401 A1 Mar. 1, 2007

(51) Int. Cl.
*H05H 9/04* (2006.01)
*H01J 25/10* (2006.01)

(52) U.S. Cl. ..... 315/5.41; 315/5.42; 315/5.39; 315/505; 315/506; 315/111.61

(58) Field of Classification Search ..... 315/5.41, 315/5.42, 5.39, 505, 506, 111.61
See application file for complete search history.

(56) References Cited

U.S. PATENT DOCUMENTS

| | | | | |
|---|---|---|---|---|
| 4,162,423 | A | 7/1979 | Tran | |
| 4,286,192 | A | 8/1981 | Tanabe et al. | |
| 5,661,377 | A * | 8/1997 | Mishin et al. | 315/505 |
| 6,366,021 | B1 * | 4/2002 | Meddaugh et al. | 315/5.41 |
| 6,864,633 | B2 * | 3/2005 | Trail et al. | 315/5.41 |
| 2005/0134203 | A1 * | 6/2005 | Salop et al. | 315/500 |

* cited by examiner

*Primary Examiner*—Nikita Wells
(74) *Attorney, Agent, or Firm*—Bingham McCutchen LLP

(57) ABSTRACT

A device for generating a particle beam includes a particle source, and a structure having a first section and a second section, the first section coupled to the particle source, the first section having a first power input, and the second section having a second power input, wherein the first section is configured to produce a particle beam having a first energy $E_1$, and the second section is configured to increase or decrease the first energy $E_1$ by an amount $E_2$, the absolute value of $E_2$ being less than $E_1$.

35 Claims, 2 Drawing Sheets

STANDING WAVE PARTICLE BEAM ACCELERATOR HAVING A PLURALITY OF POWER INPUTS

BACKGROUND OF THE INVENTION

1. Field of the Invention

This invention relates generally to devices and methods for generating. particle beams, and more particularly, to electron accelerators for generating electron beams of different energies.

2. Background of the Invention

Standing wave electron beam accelerators have found wide usage in medical accelerators where the high energy electron beam is employed to generate x-rays for therapeutic and diagnostic purposes. Electron beam generated by an electron beam accelerator can also be used directly or indirectly to kill infectious pests, to sterilize objects, to change physical properties of objects, and to perform testing and inspection of objects, such as radioactive containers and concrete structures.

When using an electron beam accelerator for various applications, it is desirable that the accelerator be capable of generating electron beam at various prescribed energy levels. For example, for a certain application, it may be desirable to have an accelerator that can generate electron beams at 8 MeV and 5 MeV. It is also desirable that the generated electron beam at each of the different energy modes has a sharp and well-focused energy spectrum. However, existing accelerators may not be able to accomplish these objectives easily and/or satisfactorily.

SUMMARY OF THE INVENTION

In accordance with some embodiments, a device for generating a particle beam includes a particle source, and a structure having a first section coupled to the particle source and a second section, the first section having a first length along an axis of the first section, the'second section having a second length along an axis of the second section, and the second length being shorter than the first length, wherein the first section has a first power input and the second section has a second power input.

In accordance with other embodiments, a device for generating a particle beam includes a particle source, a structure having a first section and a second section, each of the first and the second sections having one or more electromagnetic cavities, and a power system configured to deliver a first power to the first section, and a second power to the second section, such that a power per unit length or a power per cavity is approximately the same for the first and the second sections.

In accordance with other embodiments, a device for generating a particle beam includes a particle source, and a structure having a first section and a second section, the first section coupled to the particle source, the first section having a first power input, and the second section having a second power input, wherein the first section is configured to produce a particle beam having a first energy E1, and the second section is configured to increase or decrease the first energy E1 by an amount E2, the absolute value of E2 being less than E1.

In accordance with other embodiments, a method for generating a particle beam, includes providing a structure having a first section and a second section, each of the first and the second sections having one or more electromagnetic cavities, delivering a first power to the first section, and delivering a second power to the second section, wherein the steps of delivering are performed such that a power per accelerating cavity for the first section and a power per accelerating cavity for the second section are approximately the same.

In accordance with other embodiments, a method for generating a particle beam includes providing a structure having a first section and a second section, delivering a first power to the first section, and delivering a second power to the second section, wherein the steps of delivering are performed such that a power per unit length for the first section and a power per unit length for the second section are approximately the same.

In accordance with other embodiments, a method for generating a particle beam includes providing a structure having a first section and a second section, delivering a first power to the first section to produce a particle beam having a first energy E1, and delivering a second power to the second section to increase or decrease the first energy E1 by an amount E2, the absolute value of E2 being less than E1.

Other and further aspects and features of the invention will be evident from reading the following detailed description of the preferred embodiments, which are intended to illustrate, not limit, the invention.

BRIEF DESCRIPTION OF THE DRAWINGS

The drawings illustrate the design and utility of preferred embodiments of the present invention, in which similar elements are referred to by common reference numerals. In order to better appreciate how the above-recited and other advantages and objects of the present inventions are obtained, a more particular description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE EMBODIMENTS

Figure 1:
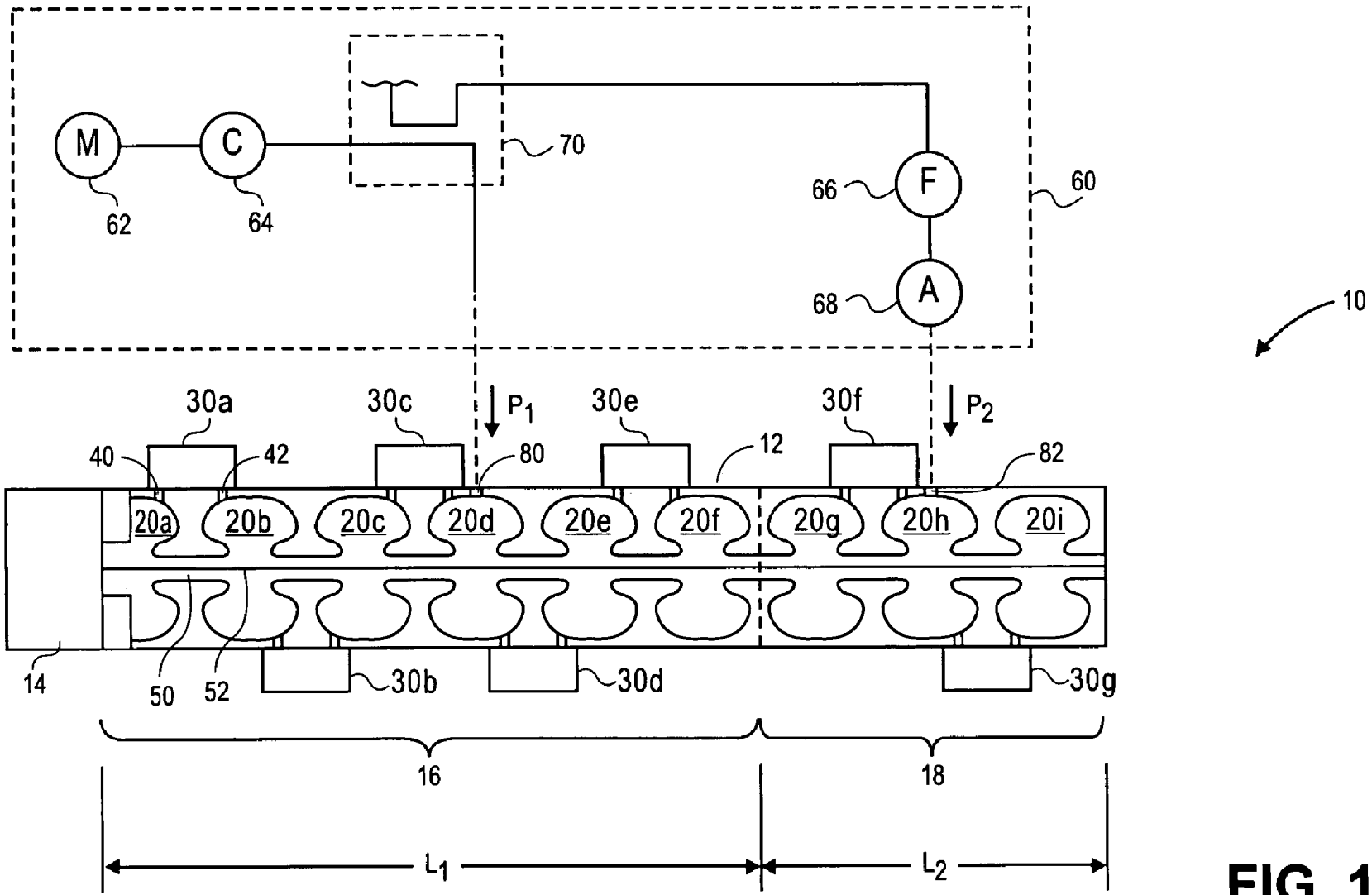
FIG. 1 is a schematic cross sectional view of an electron accelerator in accordance with some embodiments of the invention.

Various embodiments of the present invention are described hereinafter with reference to the figures. It should be noted that the figures are not drawn to scale and that elements of similar structures or functions are represented by like reference numerals throughout the figures. It should also be noted that the figures are only intended to facilitate the description of specific embodiments of the invention. They are not intended as an exhaustive description of the invention or as a limitation on the scope of the invention. In addition, an illustrated embodiment needs not have all the aspects or advantages of the invention shown. An aspect or an advantage described in conjunction with a particular embodiment of the present invention is not necessarily limited to that embodiment and can be practiced in any other embodiments of the present invention even if not so illustrated.

FIG. 1 is a schematic side sectional view of an electron beam standing wave accelerator 10 embodying embodiments of the invention. The accelerator 10 includes an electron source 14 for generating electrons, and a structure 12 coupled to the electron source 14 for bunching and accelerating the electrons. The structure 12 includes a first section 16 and a second section 18, with the first section 16 having a plurality of axially aligned cavities 20*a*-20*f* (electromagnetically coupled resonant cavities), and the second section 18 having a plurality of axially aligned cavities 20*g*-20*i*. In the illustrated embodiments, no coupling is provided between the cavities 20*f* and 20*g*, thereby creating the two sections 16, 18. It should be noted that the number of cavities 20 in each of the sections 16, 18 should not be limited to the example shown, and that in other embodiments, the first and the sections 16, 18 can have other numbers of cavities. In the illustrated embodiments, each of the electromagnetic cavities 20 has a central beam apertures 50 which permits passage of an electron beam 52 generated. by the electron source 14. The structures defining the cavities 20 preferably each has a projecting nose 54 of optimized configuration in order to improve efficiency of interaction of microwave power and the electron beam 52. The structure 12 can be constructed by connecting a plurality of cells in a series to form the cavities 20. Alternatively, the first and the second sections 16, 18 can be constructed as separate components, and are then connected to form the structure 12. In another alternative, the first and the second sections 16, 18 can be constructed as a single unit. It should be noted that the manner in which the structure 12 is constructed is unimportant, and should not be used to limit the scope of the invention.

In the illustrated embodiments, the cavities 20 in the first section 16 and the second section 18 have the same dimension along an axis of the accelerator 10. In alternative embodiments, the cavities 20*a-f* in the first section 16 each has a first length along an axis of the accelerator 10, and the cavities 20*g*-20*i* each has a second length along an axis of the accelerator 10 that is different from the first length. In other embodiments, the cavities 20 can be configured to have different lengths for allowing synchronization of the electron bunch in phase with respect to an imposed RF field (e.g., for achieving RF field focusing) for at least some of the cavities that the bunched electrons travel therethrough, thereby producing a maximum combination of beam transmission and spectral sharpness. For example, in some embodiments, the cell lengths in the first section 16 can be configured for optimum bunching and/or focusing of the electron beam 52.

The accelerator 10 also include a plurality of coupling bodies 30*a-g*, each of which having a coupling cavity (not shown) that electromagnetically couples to two adjacent resonant cavities via irises or openings 40, 42. In the illustrated embodiments, no coupling cavity and no irises are provided between the cavities 20*f*, 20*g*, thereby creating the two sections 16, 18. In other embodiments, the two sections 16, 18 can be created using other mechanisms known in the art. In other embodiments, instead of the coupling bodies 30 coupled to sides of the main body 12 (off-axis coupling), the coupling bodies can be implemented as on-axis coupling cells to reduce the overall profile of the accelerator 10. In the illustrated embodiments, the coupling bodies 30 are used for resonant coupling. Alternatively, for the case of non-resonant coupling, the coupling bodies 30 are optional, in which case, the accelerator 10 does not include the coupling bodies 30.

In the illustrated embodiments, the accelerator 10 further includes a power system 60 for delivering microwave power to the first and the second sections 16, 18. The power system 60 includes a microwave source (or a power source) 62, a circulator 64, a phase shifter 66, an attenuator 68, and a coupler 70. During use, the standing wave accelerator 10 is excited by a microwave power delivered by the microwave source 62 at a frequency near its resonant frequency, for example, between 1000 MHz and 20 GHz, and more preferably, between 2800 and 3000 MHz. The microwave source 62 can be a Magnetron, a Klystron, both of which are known in the art, or the like. In some embodiments, the power source 62 includes a control, such as a knob, that allows a user to adjust a power during use. Alternatively, the power source 62 is connected to a processor, which controls an operation of the power source 62. In other embodiments, the power source 62 can be configured to deliver constant or variable power.

The circulator 64 is configured to diverge a generated microwave power into a separate load, thereby allowing the radio frequency power to be delivered to the structure 12 unimpeded. In other words, the circulator 64 protects the power. source from reflection(s) from the guide. The circulator 64 can be implemented using mechanical and/or electrical components known in the art. Although the power source 62 and the circulator 64 are illustrated as separate components, in alternative embodiments, the power source 62 and the circulator 64 can be implemented as a single component. In other embodiments, the circulator 64 is a component which, with load, functions as an isolator. In such cases, a conventional isolator or a customized isolator may be used instead. Also, in other embodiments, the circulator 64 is optional, and the accelerator 10 does not include the circulator 64.

The coupler 70 is configured to couple some of the power generated by the power source 62 to the second section 18. In the illustrated embodiments, the coupler 70 is sized to provide approximately equal power dissipation per cell in each of the first and the second sections 16, 18. The amount of power the coupler 70 couples to the second section 18 can be different in different embodiments. In some embodiments, the coupler 70 is a 10 db coupler configured to couple approximately 10% of a generated microwave power to the section 18, resulting in approximately 90% of the microwave power being delivered to the first section 16. In other embodiments, the coupler 70 can be any of 6 db to 10 db couplers. In further embodiments, other couplers, such as a 3 db coupler or a 20 db coupler can be used, depending on how much of the generated power is to be delivered to each of the sections 16, 18.

The phase shifter 66 is configured to control or adjust a relative phase of the electric field between the first and the second sections 16, 18, such that electrons arrive to the first section 16 at a first phase and to the second section 18 at a second phase. In the illustrated embodiments, the phase shifter 66 is configured to adjust a relative phase of an electric field between the first and the second sections by delaying radio frequency energy delivered to the second section 18. Alternatively, the phase shifter 66 can be configured to adjust a relative phase of an electric field between the first and the second sections by delaying radio frequency energy delivered to the first section 18, in which cases, the phase shifter 66 will be coupled between the power source 62 and the first section 16. In further embodiments, more than one phase shifter 66 can be used (e.g., with one coupled between the power source 62 and the first section 16, and another coupled between the coupler 70 and the second section 18. The phase shifter 66 is a ±90° phase shifter, but alternatively, can be a ±180° phase shifter, a ±360° phase shifter, or any of other degree phase shifters. In the illustrated embodiments, the phase shifter 66 is an electrical phase shifter, which allows a phase to be changed quickly by changing a current. For example, an electrical phase shifter having a ferrite with an external electromagnet can be used. Alternatively, the phase shifter 66 can be a mechanical phase shifter, such as a ceramic element sized to be inserted into an electric field region. The phase shifter 66 can also be implemented using other mechanical and/or electrical components known in the art in other embodiments. In some embodiments, the phase shifter 66 is configured to switch between phases within 5 millisecond or less. For example, the phase shifter 66 can be a ferrite phase shifter that can switch phase quickly. Alternatively, the phase shifter 66 can be configured to switch between phases at other rates. In some embodiments, the phase shifter 66 includes a control, such as a knob, that allows a user to adjust a relative phase of electric field between the first and the second sections 16, 18 during use. By making small changes in the phase, one can achieve large changes in energy spread and spot size for the generated beam. Alternatively, the phase shifter 66 is connected to a processor, which controls an operation of the phase shifter 66.

The attenuator 68 is configured to control an attenuation of radio frequency power passing therethrough, thereby allowing a desired power to be delivered to the second section 18. Although the phase shifter 66 and the attenuator 68 are illustrated as separate components, in alternative embodiments, the phase shifter 66 and the attenuator 68 can be a single component. Also, in other embodiments, the attenuator 68 is optional. For example, if the coupler 64 is capable of delivering a desired power to the second section 18 or if a customized coupler is used, then the power system 60 may not include the attenuator 68.

During use, the power source 62, in cooperation with the coupler 70 (and either or both of the circulator 64 and the attenuator 68 if they are provided), delivers a first power $P_1$ to the first section 16, and a second power $P_2$ to the second section 18. The first power $P_1$in a form of radio frequency energy, enters one of the resonant cavities (e.g., cavity 20*d*) unimpeded in the first section 16, through an opening. 80 (which functions as a power input for the first section 16). Similarly, the second power $P_2$, in a form of radio frequency energy, enters one of the resonant cavities (e.g., cavity 20*h*) unimpeded in the second section 18, through an opening 82 (which functions as a power input for the second section 18). As a result, standing waves are induced in the cavities 20 in the first and the second sections 16, 18 by the applied microwave energy. Because the first and the second sections 16, 18 are not coupled electromagnetically, power entered into the first section 16 does not substantially affect the second section 18, and vice versa. As should be known to skilled in the art, the power delivered to the first section and the power delivered to the second section will depend on the amount of power provided by the power source 62, the configuration of the coupler 70, and the configuration of the attenuator 68.

In accordance with some embodiments of the invention, the power system 60 is configured to deliver the first power $P_1$ to the first section 16, and the second power $P_2$ to the second section 18, such that a power (or power dissipation) per cavity in the first section 16 ($=P_1/n_1$, where $n_1$ is the number of cavities in the first section 16) is approximately equal to (e.g., does not differ by more than 10%) a power per cavity in the second section 18 ($P_2/n_2$, where $n_2$ is the number of cavities in the second section 18). In the illustrated embodiments, approximately 66.6% of the generated power will go to the first section 16 (having six cells), with the remaining power goes to the second section 18 (having three cells), thereby making the power per cavity in the first and the second sections 16, 18 approximately equal. Such configuration allows the cavities 20 to be tuned so that they have approximately the same resonant frequency, which in turn, allows power to be delivered to the structure 12 efficiently. Such configuration also allows the first and the second sections 16, 18 to have approximately the same electric field, and approximately the same increase of temperature during use, thereby allowing the accelerator 10 to operate in a more predictable and desirable manner. Alternatively, if the cavities 20 in the first and the second sections 16, 18 have approximately the same dimension (e.g., same length along the length of the accelerator 10), the power system 60 is configured to deliver the first power $P_1$ to the first section 16, and the second power $P_2$ to the second section 18, such that a power per unit length in the first section 16 ($=P_1/L_1$, where $L_1$ is the length of the first section 16) is approximately equal to (e.g., does not differ by more than 10%) a power per unit length in the second section 18 ($=P_2/L_2$, where $L_2$ is the length of the second section 18).

Figure 2:
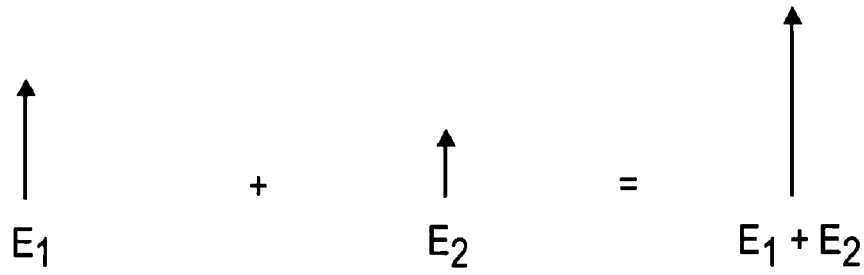
FIG. 2 illustrates a vector diagram representing a first mode of operation of the accelerator of FIG. 1.
Figure 3:
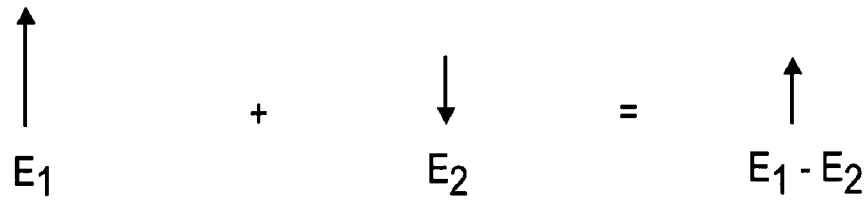
FIG. 3 illustrates a vector diagram representing a second mode of operation of the accelerator of FIG. 1.

Also, in accordance with another aspect of the invention, the first length $L_1$ of the first section 16 is longer than the second length $L_2$ of the second section 18. Such configuration allows the first section 16 of the structure 12 to generate a relatively strong electron beam, which in turn, allows the second section 18 to adjust an energy level of the beam at downstream to obtain desired beam characteristics. FIGS. 2 and 3 illustrate vector diagrams representing energies of an electron beam generated by the accelerator 10 in a first mode and a second mode of operation, respectively. In the diagrams, $E_1$ represents an energy of the electron beam 52 provided by the first section 16, and $E_2$ represents a change of energy of the electron beam 52 induced by the second section 18. The amplitude of vector $E_1$ is larger than the amplitude of vector $E_2$, representing. the condition that the energy produced by the first section 16 is larger than a change of power induced by the second section 18. In the first mode of operation, the phase shifter 66 causes the electron bunch to arrive in a same phase with respect to an imposed RF field for the first and the second sections 16, 18. This results in the first energy E1 being in phase with the second energy E2, and allows vector $E_2$ to be added to vector $E_1$ to produce a resulting vector $E_{T1}$, representing an energy of the electron beam 52 generated by the accelerator 10 in the first mode of operation. In the second mode of operation, the phase shifter 66 causes the electron bunch to arrive at a first phase relative to an imposed RF field in the first section 16, and to arrive at a second phase that is opposite from the first phase in the second section 18. This results in the first energy E1 being in opposite phase with the second energy E2, and allows vector $E_2$ to be subtracted to vector $E_1$ to produce a resulting vector $E_{T2}$, representing an energy of the electron beam 52 generated by the accelerator 10 in the second mode of operation. Small changes in the phase shift at either minimum or maximum energy may be made to keep the beam near the crest and to adjust for minimum energy spread.

As illustrated by the diagrams, using the first section 16 to provide a stronger beam (a higher value of $E_1$ than $E_2$) is advantageous because the resulting electron beam still has a positive value ($=E_1-E_2$) in the second mode, thereby preventing the electron beam generated by the first section 16 from being "stopped". Using the first section 16 to provide a stronger beam also allows the second section 18 to have better control in adjusting a beam energy since the electron beam 52 generated by the first section 16 is more energized. Also, using the phase shifter 66 to cause electron bunch to arrive in a same phase (as represented by vectors $E_1$, $E_2$ pointing in a same direction) or in an opposite phase (as represented by vectors $E_1$, $E_2$ pointing in opposite directions) at the first and the second sections 16, 18 is advantageous because it allows a maximum combination of beam transmission and spectral sharpness be produced for each of the two modes. This in turn allows the accelerator 10 to produce an energy beam for each of the two modes with optimized spectrum. In addition, having energy gains $E_1$ and $E_2$ in aiding or opposing phases will cause minimum degradation of energy spectrum. In some cases, a modest change from the aiding or opposing phase situation can result in a significant change in energy spectrum (e.g., increasing or decreasing spectral width with minimal change in energy or beam size).

It should be noted that, in other embodiments, the accelerator 10 can have different configurations to generate a relatively strong beam in the first section 16. For example, in alternative embodiments, the first length $L_1$ of the first section 16 can have a length that is the same or shorter than the second length $L_2$ of the second section 18. In such cases, the power system 60 can be configured to deliver a much higher power to the first section 16 than the second section 18, such that an absolute value of $E_1$ resulted from the first section 16 is larger than an absolute value of $E_2$ resulted from the second section 18. Such configuration may result in the first and the second sections 16, 18 having different operating temperatures. In some embodiments, the accelerator 10 can further include a temperature regulation system that regulates a temperature for each of both of the first and the second sections 16, 18, thereby allowing the sections 16, 18 to operate in approximately the same temperature.

The above described feature(s) allow the accelerator 10 to provide two energy modes for the generated electron beam 52, each of which having optimized spectrum and sharpness. The actual energy level of the beam 52 in each of the two modes can be different in different embodiments. In one example, the first section 16 of the accelerator 10 is configured to provide an electron beam having an energy level of approximately 6.5 mega-electron volts (MeV), and the second section 18 is configured to reduce or increase the beam energy by 1.5 MeV, thereby providing two energy modes of approximately 8 MeV and 5 MeV. It should be noted that accelerators having different configurations can be constructed in accordance with different embodiments of the invention. For example, in other embodiments, the accelerator can be configured to generate a beam of electrons having an energy levels that are different from 5 MeV and/or 8 MeV.

Figure 4:
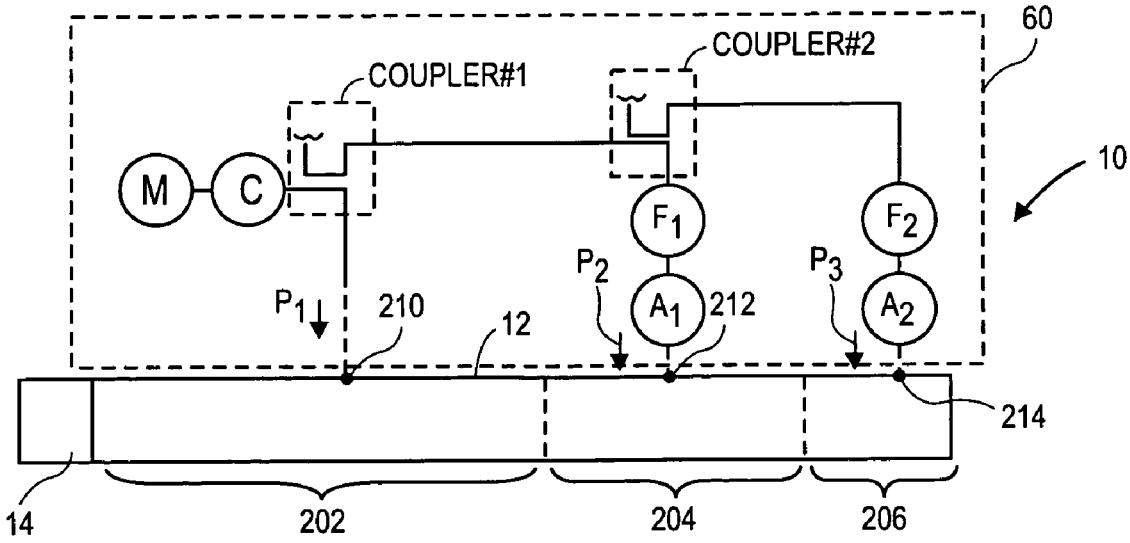
FIG. 4 illustrates a schematic cross sectional view of an electron accelerator in accordance with other embodiments of the invention.

Also, in alternative embodiments, instead of having two sections 16, 18, the accelerator 10 can have more than two sections, with each of the sections having a power input along the length of the section. For example, in other embodiments, the accelerator 10 can have three sections 202, 204, 206 having three respective power inputs 210, 212, 214 (FIG. 4). The first section 202 is configured to provide an electron beam having a first energy $E_1$, the second section 204 is configured to induce a change of the electron beam energy by $E_2$, and the third section 206 is configured to induce a change of the electron beam energy by $E_3$. In such cases, the accelerator 10 is capable of providing three modes of electron beam energies $E_{T1}$, $E_{T1}$, $E_{T1}$, $E_{T4}$, where $E_{T1}=E_1+E_2+E_3$, $E_{T2}=E_1-E_2+E_3$, $E_{T3}=E_1+E_2-E_3$, $E_{T4}=E_1-E_2-E_3$.

Although the power system 60 has been described as being configured to deliver the first power $P_1$ to the first section 16, and the second power $P_2$ to the second section 18, such that a power per cavity, or a power per unit length, in each of the first and the sections 16, 18 is approximately equal, the scope of the invention should not be so limited. In alternative embodiments, the power system 60 can be configured to deliver the first power $P_1$ to the first section 16, and the second power $P_2$ to the second section 18, such that a power per cavity, or a power per unit length, in each of the first and the sections 16, 18 is different.

Although particular embodiments of the present inventions have been shown and described, it will be understood that it is not intended to limit the present inventions to the preferred embodiments, and it will be obvious to those skilled in the art that various changes and modifications may be made without departing from the spirit and scope of the present inventions. For examples, in other embodiments, instead of being a standing wave guide, the accelerator 10 can be a traveling wave guide. Also, in other embodiments, instead of operating in $\eta/2$ mode, the accelerator 10 can be configured to operate in $2\pi/3$ mode, or other modes. The specification and drawings are, accordingly, to be regarded in an illustrative rather than restrictive sense. The present inventions are intended to cover alternatives, modifications, and equivalents, which may be included within the spirit and scope of the present inventions as defined by the claims.

What is claimed:

1. A device for generating a particle beam, comprising:

a particle source; and a structure having a first section coupled to the particle source and a second section, the first section having a first length along an axis of the first section, the second section having a second length along an axis of the second section, and the second length being shorter than the first length, wherein the first section has a first power input and the second section has a second power input.

2. The device of claim 1, further comprising a power system for delivering a first power to the first power input and a second power to the second power input.

3. The device of claim 2, wherein the first power and the second power are selected such that a power per unit length is the same for each of the first and the second sections.

4. The device of claim 2, wherein each of the first and the second sections has one or more electromagnetic cavities, and the first power and the second power are selected such that a power per cavity is the same for each of the first and the second sections.

5. The device of claim 2, wherein the power system comprises:

a power source coupled to one of the first and the second power inputs; and a coupler for coupling power to another of the first and the second power inputs.

6. The device of claim 5, further comprising a circulator coupled to the power source.

7. The device of claim 1, further comprising a phase shifter for adjusting a relative phase of electric field between the first and the second sections.

8. The device of claim 7, wherein the phase shifter comprises a ±90° phase shifter.

9. The device of claim 1, wherein the particle source comprises an electron source.

10. A device for generating a particle beam, comprising:

a particle source;

a structure having a first section and a second section, each of the first and the second sections having one or more electromagnetic cavities; and a power system configured to deliver a first power to the first section, and a second power to the second section, such that a power per unit length or a power per cavity is approximately the same for the first and the second sections.

11. The device of claim 10, wherein the power system comprises:

a power source coupled to one of the first and the second sections; and a coupler for coupling power to another of the first and the second sections.

12. The device of claim 11, further comprising a circulator coupled to the power source.

13. The device of claim 10, further comprising a phase shifter for adjusting a relative phase of electric field between the first and the second sections.

14. The device of claim 13, wherein the phase shifter comprises a ±90° phase shifter.

15. The device of claim 10, wherein the first section has a length that is longer than that of the second section.

16. The device of claim 10, wherein the first section has a length that is approximately the same as that of the second section.

17. The device of claim 10, wherein the particle source comprises an electron source.

18. A device for generating a particle beam, comprising:

a particle source; and a structure having a first section and a second section, the first section coupled to the particle source, the first section having a first power input, and the second section having a second power input;

wherein the first section is configured to produce a particle beam having a first energy $E_1$, and the second section is configured to increase or decrease the first energy $E_1$ by an amount $E_2$, an absolute value of $E_2$ being less than an absolute of $E_1$.

19. The device of claim 18, further comprising a power system for delivering a first power to the first section and a second power to the second section.

20. The device of claim 19, wherein the first power and the second power are selected such that a power per unit length is the same for the first and the second sections.

21. The device of claim 19, wherein each of the first and the second sections has one or more electromagnetic cavities, and the first power and the second power are selected such that a power per cavity is the same for the first and the second sections.

22. The device of claim 18, further comprising a phase shifter for adjusting a relative phase of electric field between the first and the second sections.

23. The device of claim 22, wherein the phase shifter comprises a ±90° phase shifter.

24. The device of claim 18, wherein the particle source comprises an electron source.

25. The device of claim 18, wherein the first section has a length that is longer than that of the second section.

26. The device of claim 18, wherein the first section has a length that is approximately the same as that of the second section.

27. A method for generating a particle beam, comprising:

providing a structure having a first section and a second section, each of the first and the second sections having one or more electromagnetic cavities;

delivering a first power to the first section; and delivering a second power to the second section;

wherein the steps of delivering are performed such that a power per accelerating cavity for the first section and a power per accelerating cavity for the second section are approximately the same.

28. The method of claim 27, wherein the first section has a length that is longer than that of the second section.

29. A method for generating a particle beam, comprising:

providing a structure having a first section and a second section;

delivering a first power to the first section; and delivering a second power to the second section;

wherein the steps of delivering are performed such that a power per unit length for the first section and a power per unit length for the second section are approximately the same.

30. The method of claim 29, wherein the first section has a length that is longer than that of the second section.

31. A method for generating a particle beam, comprising:

providing a structure having a first section and a second section;

delivering a first power to the first section to produce a particle beam having a first energy $E_1$; and delivering a second power to the second section to increase or decrease the first energy $E_1$ by an amount $E_2$, an absolute value of $E_2$ being less than an absolute value of $E_1$.

32. The method of claim 31, wherein the first section has a length that is longer than that of the second section.

33. The method of claim 31, wherein each of the first and the second sections has one or more electromagnetic cavities, and the steps of delivering are performed such that a power per cavity for the first section and a power per cavity for the second section are approximately the same.

34. The method of claim 31, wherein the steps of delivering are performed such that a power per unit length for the first section and a power per unit length for the second section are approximately the same.

35. The method of claim 31, wherein the particle beam comprises an electron beam.

* * * * *